US010578347B2

(12) United States Patent
Miller et al.

(10) Patent No.: US 10,578,347 B2
(45) Date of Patent: Mar. 3, 2020

(54) ICE DISPENSER AND CRUSHER FOR A REFRIGERATOR APPLIANCE

(71) Applicant: Haier US Appliance Solutions, Inc., Wilmington, DE (US)

(72) Inventors: Charles Benjamin Miller, Louisville, KY (US); Bradley Nicholas Gilkey, Louisville, KY (US); Ansuraj Seenivasan, Hyderabad (IN); Bart Andrew Nuss, Fisherville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 15/992,281

(22) Filed: May 30, 2018

(65) Prior Publication Data

US 2019/0368798 A1 Dec. 5, 2019

(51) Int. Cl.
*F25C 5/04* (2006.01)
*F25C 5/20* (2018.01)

(52) U.S. Cl.
CPC ..... *F25C 5/046* (2013.01); *F25C 5/22* (2018.01)

(58) Field of Classification Search
CPC .... F25C 5/046; F25C 5/22; F25C 5/02; F25C 5/12; F25C 5/043
See application file for complete search history.

(56) References Cited

U.S. PATENT DOCUMENTS 4,790,531 A * 12/1988 Matsui ..... A63C 19/10 238/10 R
6,328,236 B1 * 12/2001 Upson ..... F25C 5/12 241/95
7,111,473 B2 9/2006 Chung et al.
8,794,023 B2 8/2014 Nuss
8,826,683 B2 9/2014 Nuss et al.
8,955,350 B2 2/2015 Nuss
9,377,234 B2 6/2016 Jeong et al.
2001/0025505 A1 * 10/2001 Nelson ..... F25C 5/22 62/371
2006/0059939 A1 * 3/2006 An ..... F25C 5/046 62/344
2008/0156826 A1 * 7/2008 Kim ..... F25C 5/046 221/258
2009/0133428 A1 * 5/2009 An ..... F25C 5/046 62/320
2013/0104587 A1 * 5/2013 Nuss ..... F25C 5/046 62/320
2013/0104591 A1 * 5/2013 Mitchell ..... F25C 5/18 62/344
2013/0105611 A1 * 5/2013 Nuss ..... F25C 5/22 241/277
2013/0305763 A1 * 11/2013 Nuss ..... F25C 5/046 62/320

(Continued)

*Primary Examiner* — Kun Kai Ma
(74) *Attorney, Agent, or Firm* — Dority & Manning, P.A.

(57) ABSTRACT

An ice dispensing assembly is provided that can be mounted within an appliance, such as a refrigerator appliance. The ice dispensing assembly includes an ice dispenser crusher mechanism having features that facilitate dispensing and crushing of ice. The construction of dispenser crusher mechanism provides a horizontal axis motor coupling with a vertical axis agitator and crusher for dispensing and crushing ice.

18 Claims, 12 Drawing Sheets

(56) References Cited

U.S. PATENT DOCUMENTS

| | | | | |
|---|---|---|---|---|
| 2013/0327076 | A1* | 12/2013 | Jeong | F25D 23/04 62/321 |
| 2014/0223948 | A1* | 8/2014 | Visin | F25C 5/046 62/320 |
| 2017/0363340 | A1* | 12/2017 | Li | F25C 5/046 |

* cited by examiner

ICE DISPENSER AND CRUSHER FOR A REFRIGERATOR APPLIANCE

FIELD OF THE INVENTION

The subject matter of the present disclosure relates to an ice dispenser for a refrigerator appliance and, more specifically, to an ice dispenser also having an ice crusher.

BACKGROUND OF THE INVENTION

Generally, a refrigerator appliance includes a freezer compartment and a fresh food compartment partitioned from each other. Various food items may be stored in the freezer and fresh food compartments at appropriate low temperatures. It is common to provide an automatic icemaker/water dispenser with a refrigerator. In a "side-by-side" type of refrigerator where the freezer compartment is arranged to the side of the fresh food compartment, the icemaker is usually disposed in the freezer compartment and thus utilizes the cold air in the freezer compartment, which typically includes an evaporator also disposed in the freezer compartment. In a "bottom freezer" type of refrigerator where the freezer compartment is arranged beneath a top mounted fresh food compartment, convenience necessitates that the icemaker is disposed in a sub-compartment (often referred to as an "icebox") that is usually thermally insulated and configured in one of the top mounted fresh food compartment doors with ice delivered through an opening on the door. In such an arrangement, provision must be made for providing adequate refrigeration to the icebox to enable the icemaker to form and store the ice. An access door is commonly provided on the icebox to allow the consumer to access the internal ice bucket and icemaker.

Typically, the ice maker delivers ice into a storage container or bucket where the ice is kept until used. A panel on the front of the refrigerator allows a user to select between the dispensing of crushed ice or non-crushed ice. Conventionally, to dispense crushed ice, the ice is pushed, e.g., by an auger, through a chute or channel equipped with an ice crusher having one or more blades carried on a shaft. The blades rotate with the shaft to contact and crush the ice being pushed through the chute. Chilled water can also be provided by routing a thermally conductive conduit to the panel such that the water is cooled before reaching the dispenser.

The ice container, dispenser, and ice crusher can consume a significant amount of space in the freezer or fresh food compartment. Space is consumed not only by the volume required for ice creation and storage, but also by the mechanisms for moving and/or crushing the ice. A user may prefer to have such consumed space available for food storage. Depending upon how the components are positioned within these compartments, user access to portions of the compartment and/or to the ice storage container (e.g., for cleaning or manually collecting ice) can be inconvenient as well.

Further, conventional ice dispenser and crusher assemblies have had motor couplings along a vertical axis of the refrigerator appliance with the motor being positioned below both the opening in the bucket and the dispenser crusher mechanism. The vertical motor coupling requires that the ice bucket have an additional spring-loaded lever mechanism to prevent relative motion between the coupling and the drum that rotates the dispenser crusher mechanism. Such spring-loaded lever mechanisms add cost and complexity to ice dispenser crusher mechanisms. Moreover, positioning the motor below the opening in the bucket causes the motor to become wet, e.g., when the ice melts.

Accordingly, it would be advantageous to provide an ice dispensing crusher mechanism for an ice dispensing assembly that addresses one or more of these challenges.

BRIEF DESCRIPTION OF THE INVENTION

Generally, the present disclosure provides an ice dispensing assembly that can be mounted within an appliance, such as a refrigerator appliance. The ice dispensing assembly includes an ice dispenser crusher mechanism having features that facilitate dispensing and crushing of ice. The construction of dispenser crusher mechanism provides a horizontal axis motor coupling with a vertical axis agitator and crusher for dispensing and crushing ice. Aspects and advantages of the invention will be set forth in part in the following description, or may be obvious from the description, or may be learned through practice of the invention.

In one aspect of the present disclosure, an ice dispensing assembly for an appliance is provided. The ice dispensing assembly includes an ice bucket defining a cavity for stowing ice and defining an opening. The ice dispensing assembly also includes a dispenser crusher mechanism. The dispenser crusher mechanism includes a housing defining a first chamber and a second chamber, the second chamber in communication with the opening of the ice bucket for receipt of ice. Further, the dispenser crusher mechanism includes a horizontal coupling assembly defining a horizontal axis and operatively coupled with a drive motor along the horizontal axis. The horizontal coupling assembly includes a horizontal shaft rotatable about the horizontal axis and a horizontal transmission gear mounted to or integrally formed with the horizontal shaft. Further, the dispenser crusher mechanism includes a vertical drive assembly received within the first chamber of the housing and defining a first vertical axis. The vertical drive assembly includes a vertical shaft rotatable about the first vertical axis and a vertical transmission gear mounted to or integrally formed with the vertical shaft and in mechanical engagement with the horizontal transmission gear of the horizontal coupling assembly. Further, the vertical drive assembly includes a drive gear mounted to or integrally formed with the vertical shaft. In addition, the dispenser crusher mechanism includes a drum assembly defining a second vertical axis. The drum assembly includes a drum received within the second chamber and rotatable about the second vertical axis, the drum in mechanical engagement with the drive gear. The drum assembly also includes an upper bridge carried by the drum and rotatable about the second vertical axis; a lower bridge carried by the drum and rotatable about the second vertical axis; a main shaft extending along the second vertical axis, the upper and lower bridges each coupled with the main shaft; at least one rotating blade coupled with the main shaft and with the upper and lower bridges, the upper and lower bridges configured to rotate the at least one rotating blade about the second vertical axis; and at least one non-rotating blade coupled with the main shaft.

In another aspect of the present disclosure, an appliance defining a vertical direction is provided. The appliance includes a cabinet defining one or more chilled chambers. The appliance also includes an ice dispensing assembly. The ice dispensing assembly includes a drive motor having an output shaft rotatable about a horizontal axis. The ice dispensing assembly also includes an ice bucket defining a cavity for stowing ice and defining an opening. The ice dispensing assembly also includes a dispenser crusher mechanism. The dispenser crusher mechanism includes a housing defining a chamber, the chamber in communication with the opening of the ice bucket for receipt of ice. The dispenser crusher mechanism further includes a horizontal coupling assembly. The horizontal coupling assembly includes a coupling operatively coupled with the output shaft of the drive motor; a horizontal shaft coupled with the coupling and rotatable about the horizontal axis; and, a horizontal transmission gear mounted to or integrally formed with the horizontal shaft, the horizontal transmission gear rotatable with the horizontal shaft in unison. The dispenser crusher mechanism also includes a vertical drive assembly received within the chamber and defining a first vertical axis substantially orthogonal to the horizontal axis. The vertical drive assembly includes a vertical shaft rotatable about the first vertical axis; a vertical transmission gear mounted to or integrally formed with the vertical shaft and in mechanical engagement with the horizontal transmission gear of the horizontal coupling assembly; a drive gear mounted to or integrally formed with the vertical shaft. Further, the dispenser crusher mechanism includes a drum assembly defining a second vertical axis. The drum assembly includes a drum received within the chamber and rotatable about the second vertical axis, the drum in mechanical engagement with the drive gear; an upper bridge carried by the drum and rotatable about the second vertical axis; a lower bridge carried by the drum and rotatable about the second vertical axis; a main shaft extending along the second vertical axis, the upper and lower bridges each coupled with the main shaft, the upper bridge coupled with the main shaft above where the lower bridge is coupled with the main shaft along the vertical direction; at least one rotating blade coupled with the main shaft and with the upper and lower bridges, the upper and lower bridges configured to rotate the at least one rotating blade about the second vertical axis; and at least one non-rotating blade coupled with the main shaft.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
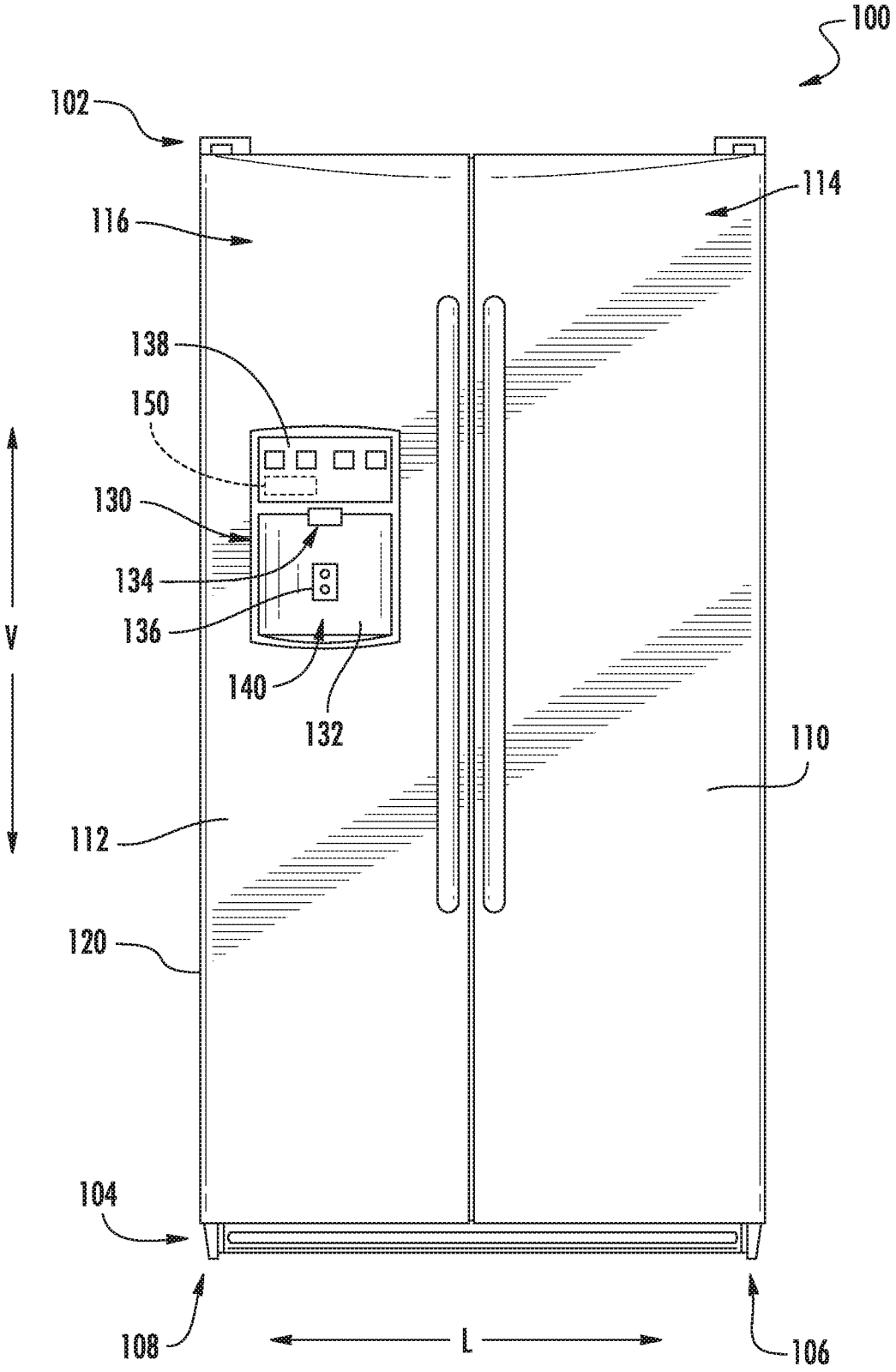
FIG. 1 provides a front view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "about", "substantially", and "approximately," refer to being within a ten percent (10%) margin of error.

Figure 2:
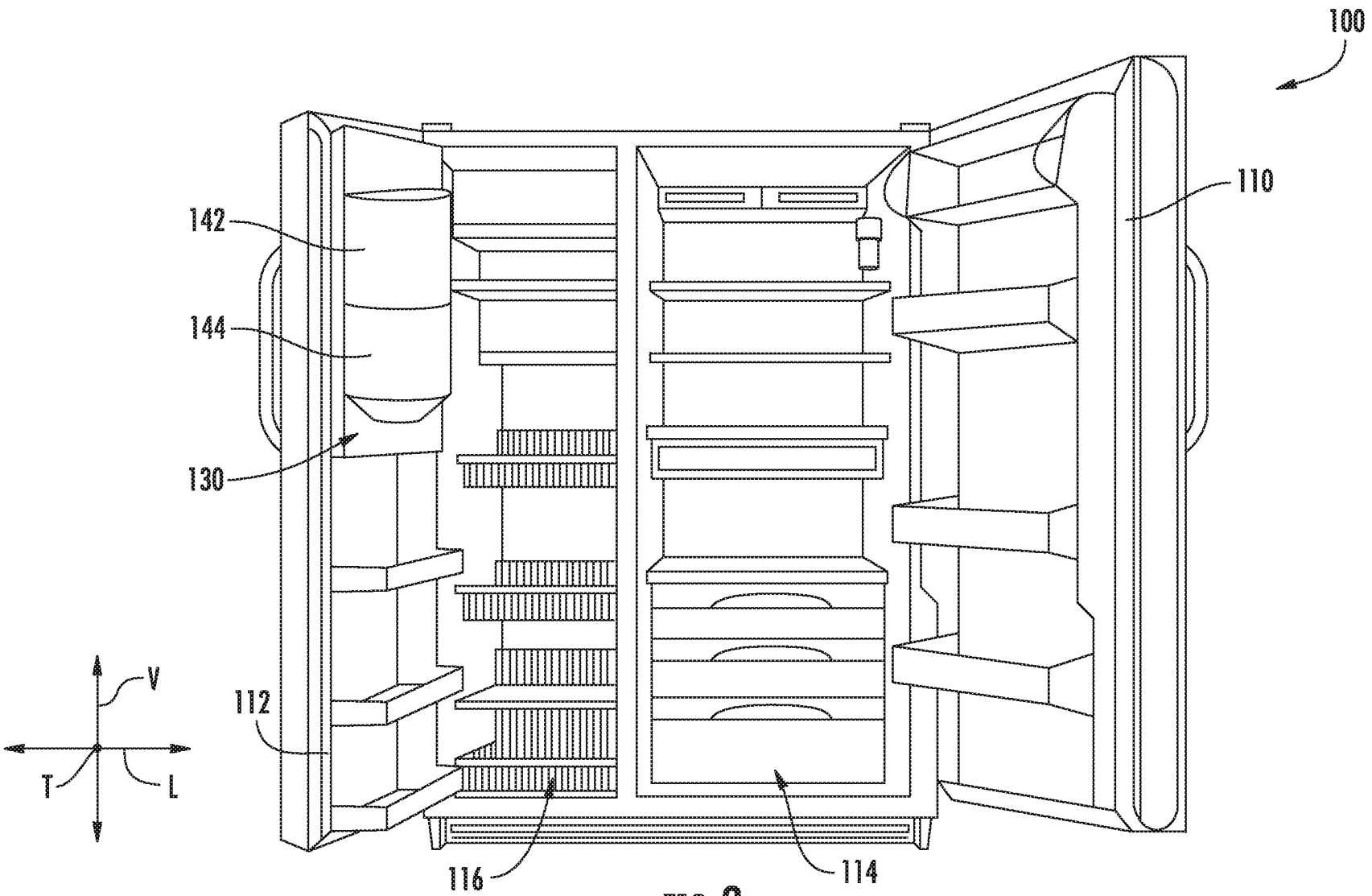
FIG. 2 provides a front perspective view of the refrigerator appliance of FIG. 1 depicting doors of the refrigerator appliance in an open position.

FIGS. 1 and 2 provide various views of a refrigerator appliance 100 according to an example embodiment of the present disclosure. In particular, FIG. 1 provides a front view of refrigerator appliance 100 and FIG. 2 provides a front, perspective view of refrigerator appliance 100 with a refrigerator door 110 and a freezer door 112 of refrigerator appliance 100 shown in an open position to reveal a fresh food chamber 114 and a freezer chamber 116 of refrigerator appliance 100. Refrigerator appliance 100 defines a vertical direction V, a lateral direction L, and a transverse direction T (FIG. 2). The vertical direction V, lateral direction L, and transverse direction T are mutually perpendicular and form an orthogonal direction system. Refrigerator appliance 100 extends between an upper portion 102 and a lower portion 104 along the vertical direction V. Refrigerator appliance 100 also extends between a first side portion 106 and a second side portion 108, e.g., along the lateral direction L. Further, although not shown in FIGS. 1 and 2, refrigeration appliance 100 extends between a front and a back along the transverse direction T.

Refrigerator appliance 100 includes a cabinet 120 (FIG. 1) that defines chilled chambers for receipt of food items for storage. For this embodiment, refrigerator appliance 100 defines fresh food chamber 114 at first side portion 106 of refrigerator appliance 100 and freezer chamber 116 arranged next to fresh food chamber 114 at second side portion 108 of refrigerator appliance 100. As such, the illustrated refrigerator appliance 100 of FIGS. 1 and 2 is generally referred to as a side-by-side style refrigerator appliance. However, using the teachings disclosed herein, one of skill in the art will understand that the present subject matter may be used with other types of refrigerator appliances (e.g., bottom mount or top mount styles) or a freezer appliance as well. Consequently, the description set forth herein is for illustrative purposes only and is not intended to limit the present subject matter in any aspect.

Refrigerator door 110 is rotatably hinged to an edge of cabinet 120 for accessing fresh food chamber 114. Similarly, freezer door 112 is rotatably hinged to an edge of cabinet 120 for accessing freezer chamber 116. Refrigerator door 110 and freezer door 112 can rotate between an open position (shown in FIG. 2) and a closed position (shown in FIG. 1) in order to permit selective access to fresh food chamber 114 and freezer chamber 116, respectively.

Refrigerator appliance 100 also includes a dispensing assembly 130 for dispensing water and/or ice. Dispensing assembly 130 includes a dispenser 132 positioned on or mounted to an exterior portion of refrigerator appliance 100, e.g., on freezer door 112. Dispenser 132 includes a discharging outlet 134 for accessing ice and water. Any suitable actuator may be used to operate dispenser 132. For example, dispenser 132 can include a paddle or button for operating dispenser. Additionally or alternatively, a sensor 136, such as an ultrasonic sensor, may be mounted below or beneath discharging outlet 134 for operating dispenser 132, e.g., during an auto-fill process of refrigerator appliance 100. A user interface panel 138 is provided for controlling the mode of operation. In some embodiments, user interface panel 138 includes a water dispensing button (not labeled) and an ice-dispensing button (not labeled) for selecting a desired mode of operation, such as e.g., crushed or non-crushed ice.

As shown particularly in FIG. 1, discharging outlet 134 and sensor 136 are an external part of dispenser 130. One or both of discharging outlet 134 and sensor 136 are mounted in a dispenser recess 140 defined in an outside surface of freezer door 112. In some embodiments, dispenser recess 140 is positioned at a predetermined elevation convenient for a user to access ice or water and enabling the user to access ice without the need to bend-over and without the need to access freezer chamber 116. In the illustrated embodiment of FIG. 1, dispenser recess 140 is positioned at a level that approximates the chest level of an adult user.

As shown particularly in FIG. 2, certain components of dispensing assembly 130 are illustrated. Dispensing assembly 130 includes a housing 142 mounted, as an example, on or within door 112. As door 112 opens and closes, housing 142 may be selectively positioned within and out of freezer chamber 116, respectively. Generally, housing 142 is constructed and arranged to facilitate production and storage of ice. More particularly, housing 142 includes or contains an ice maker for creating ice. Dispensing assembly 130 also includes an ice bucket or container 144 configured for stowing ice made by the ice maker. In some embodiments, container 144 is mounted on freezer door 112, e.g., below or beneath housing 142 along the vertical direction V. As will be described in greater detail herein, dispensing assembly 130 includes an ice dispenser and crusher mechanism. The ice dispenser and crusher mechanism may dispense ice stowed in container 144 through a chute so that ice may ultimately be dispensed out of discharging outlet 134 (FIG. 1), and if selected by a user, the ice may be crushed as well by the ice dispenser and crusher mechanism.

With reference again to FIG. 1, operation of the refrigerator appliance 100 is regulated by a controller 150 that is operatively coupled to user interface panel 138 and/or sensor 136. User interface panel 138 provides selections for user manipulation of the operation of refrigerator appliance 100 such as e.g., selections between whole or crushed ice, chilled water, and/or other options as well. In response to user manipulation of the user interface panel 138, controller 150 operates various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be positioned in a variety of locations throughout refrigerator appliance 100. In the illustrated embodiment, controller 150 is located proximate user interface panel 138 on freezer door 112. Input/output ("I/O") signals may be routed between controller 150 and various operational components of refrigerator appliance 100. For example, user interface panel 138 may be in communication with controller 150 via one or more signal lines or shared communication busses.

Figure 3:
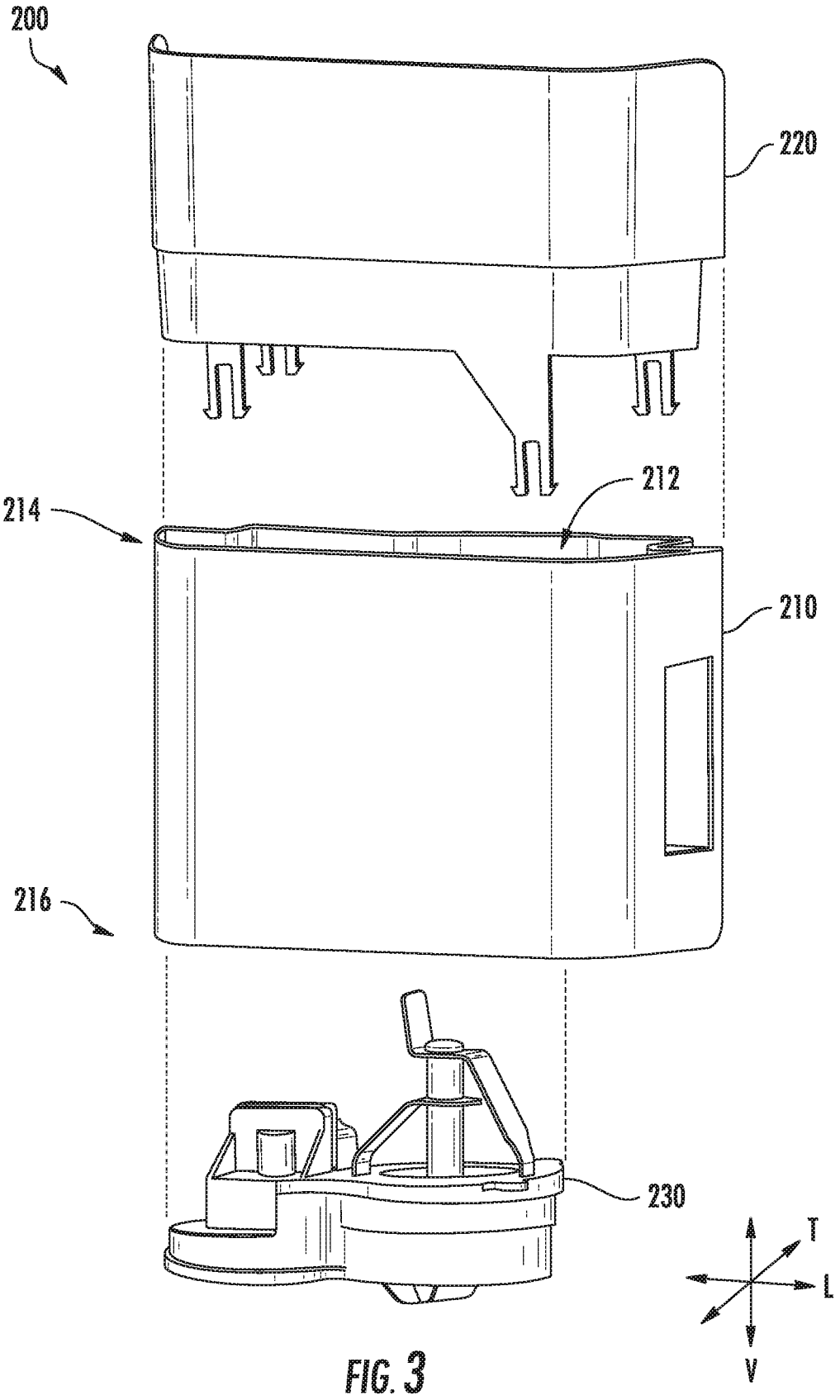
FIG. 3 provides a front exploded view of an example ice dispensing assembly according to example embodiments of the present disclosure.
Figure 4:
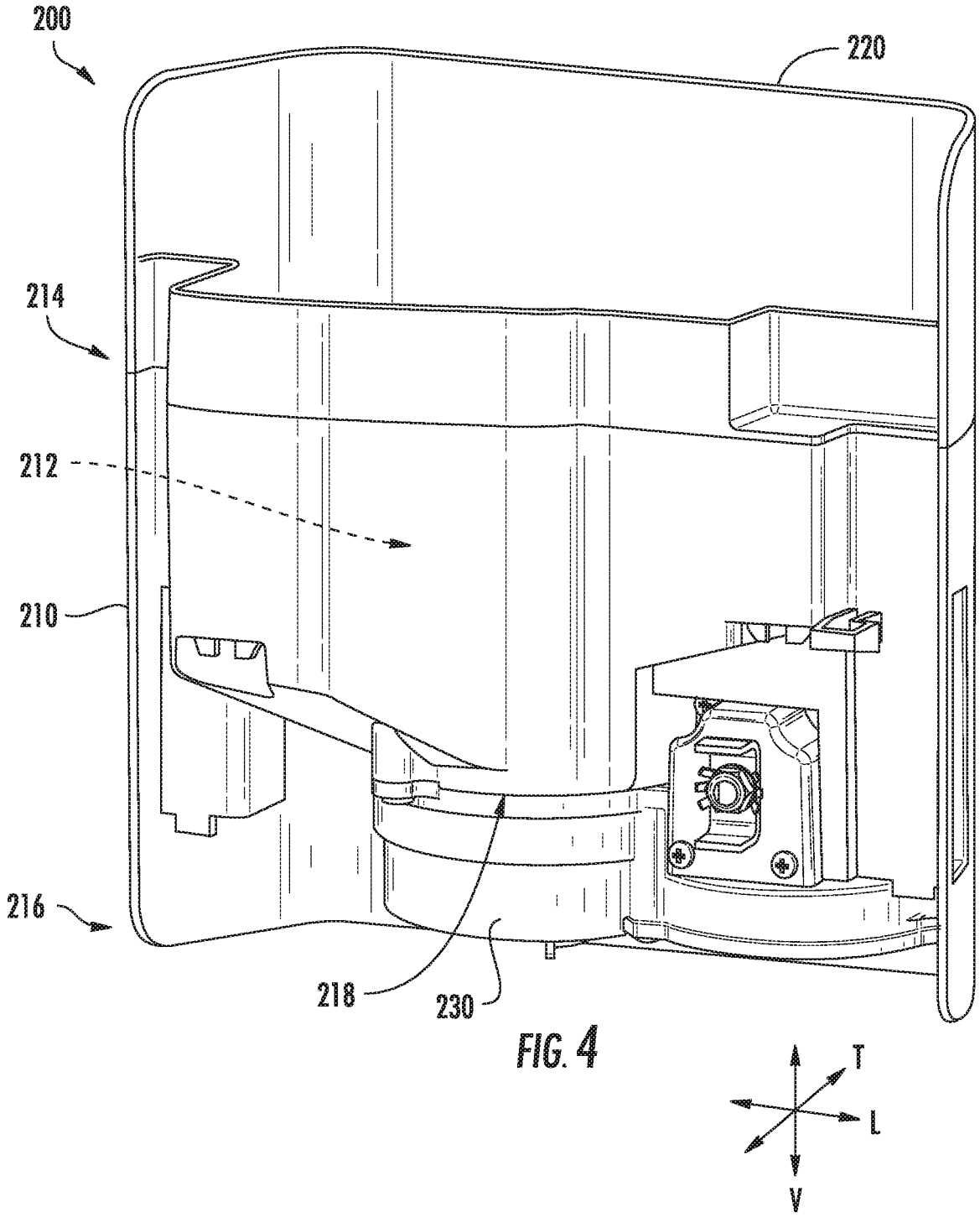
FIG. 4 provides a rear perspective view of the ice dispensing assembly of FIG. 3 assembled.

FIGS. 3 and 4 provide an example ice dispensing assembly 200 according to example embodiments of the present disclosure. In particular, FIG. 3 provides a front exploded view of an example of ice dispensing assembly 200 and FIG. 4 provides a rear perspective view of ice dispensing assembly 200. Ice dispensing assembly 200 may be used within any suitable refrigerator appliance, such as refrigerator appliance 100 (FIGS. 1 and 2). As an example, ice dispensing assembly 200 may be dispensing assembly 130 of FIG. 2. Further, similar to refrigerator appliance 100 of FIGS. 1 and 2, ice dispensing assembly 200 defines vertical direction V, lateral direction L, and transverse direction T. The vertical direction V, lateral direction L, and transverse direction T are mutually perpendicular and form an orthogonal direction system.

As shown in FIGS. 3 and 4, ice dispensing assembly 200 includes an ice bucket 210, a bucket cover 220, and a dispenser crusher mechanism 230. Ice bucket 210 defines a cavity 212 for stowing ice and extends between a top portion 214 and a bottom portion 216, e.g., along the vertical direction V. When ice dispensing assembly 200 is assembled as shown in FIG. 4, bucket cover 220 is mounted to top portion 214 of ice bucket 210. In some embodiments, bucket cover 220 is formed of a transparent material, e.g., to allow a user to view the level of ice within cavity 212 of ice bucket 210. Further, when ice dispensing assembly 200 is assembled, dispenser crusher mechanism 230 is mounted to bottom portion 216 of ice bucket 210. In particular, dispenser crusher mechanism 230 is mounted to ice bucket 210 in such a way that dispenser crusher mechanism 230 is aligned with an opening 218 defined by ice bucket 210 at bottom portion 216. In this way, dispenser crusher mechanism 230 may urge or motivate ice proximate opening 218 through dispenser crusher mechanism 230 so that ice may be dispensed into a chute (not shown) positioned vertically below dispenser crusher mechanism 230 and ultimately discharged through a designated outlet, e.g., such as discharging outlet 134 (FIG. 1). Further, if a crushed-ice mode is selected, the ice may be crushed as it is urged through dispenser crusher mechanism 230.

Figure 5:
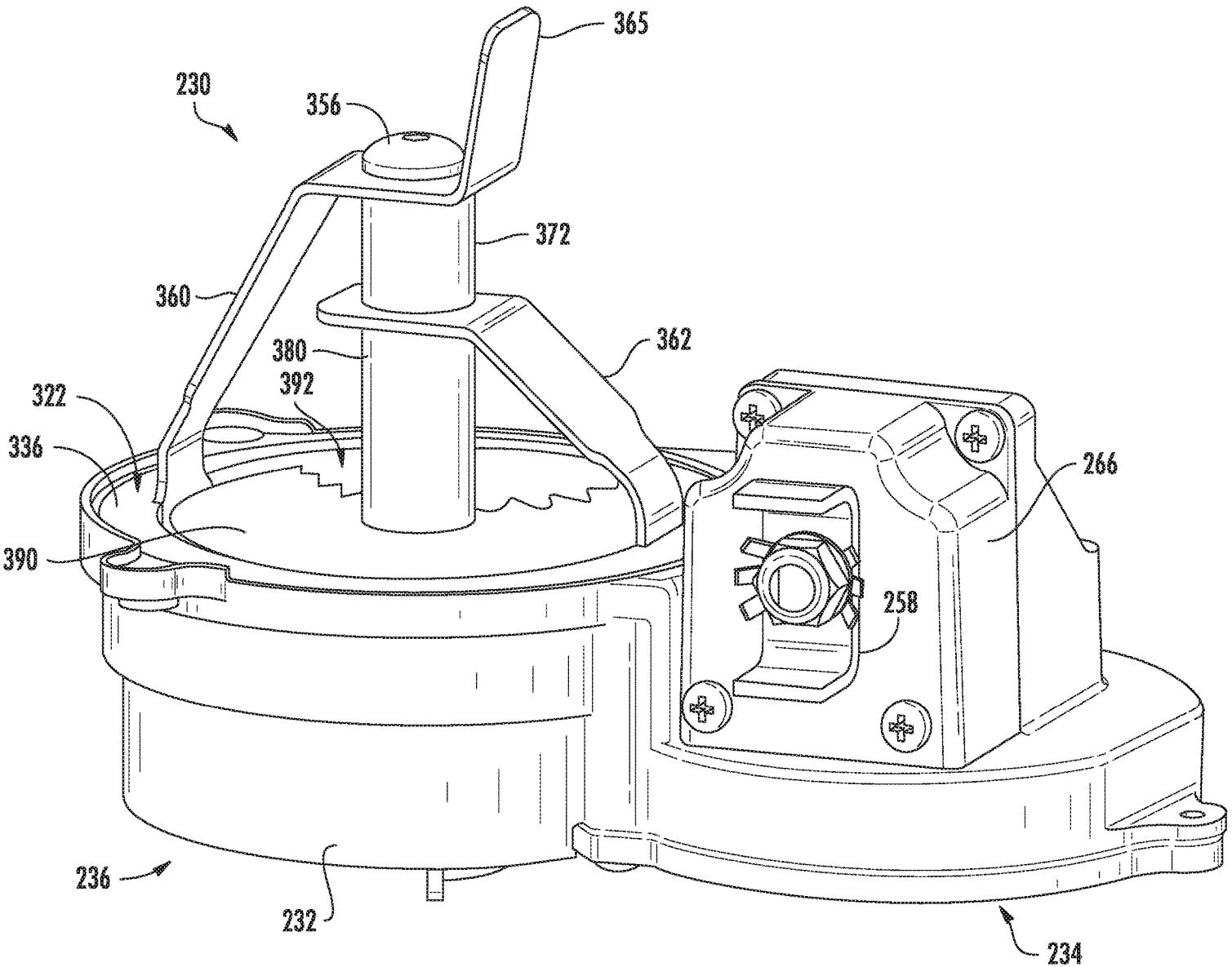
FIG. 5 provides a rear perspective view of an example ice dispenser and crusher mechanism of the ice dispensing assembly of FIG. 3.
Figure 6:
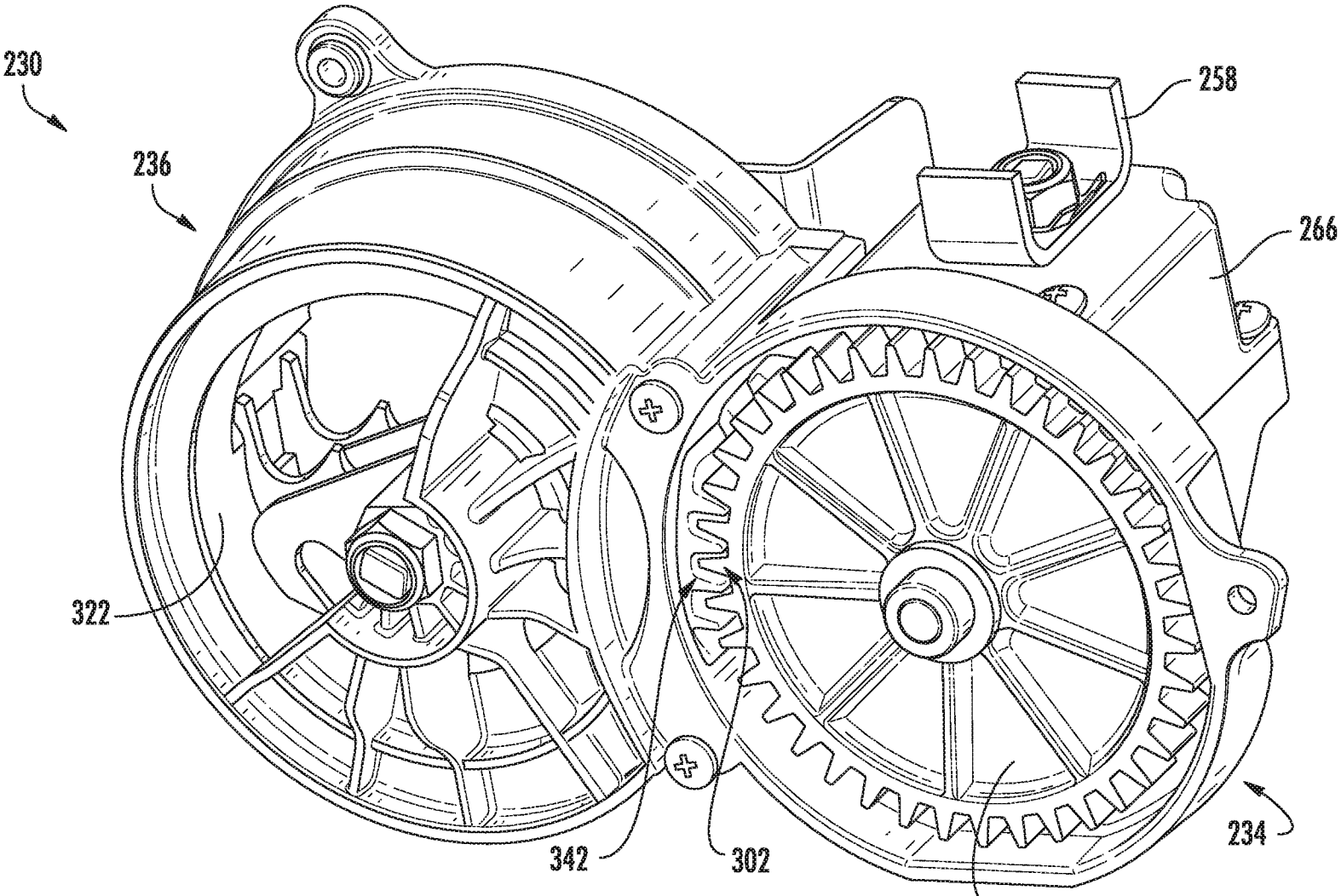
FIG. 6 provides a bottom perspective view of the ice dispenser and crusher mechanism of FIG. 5.
Figure 7:
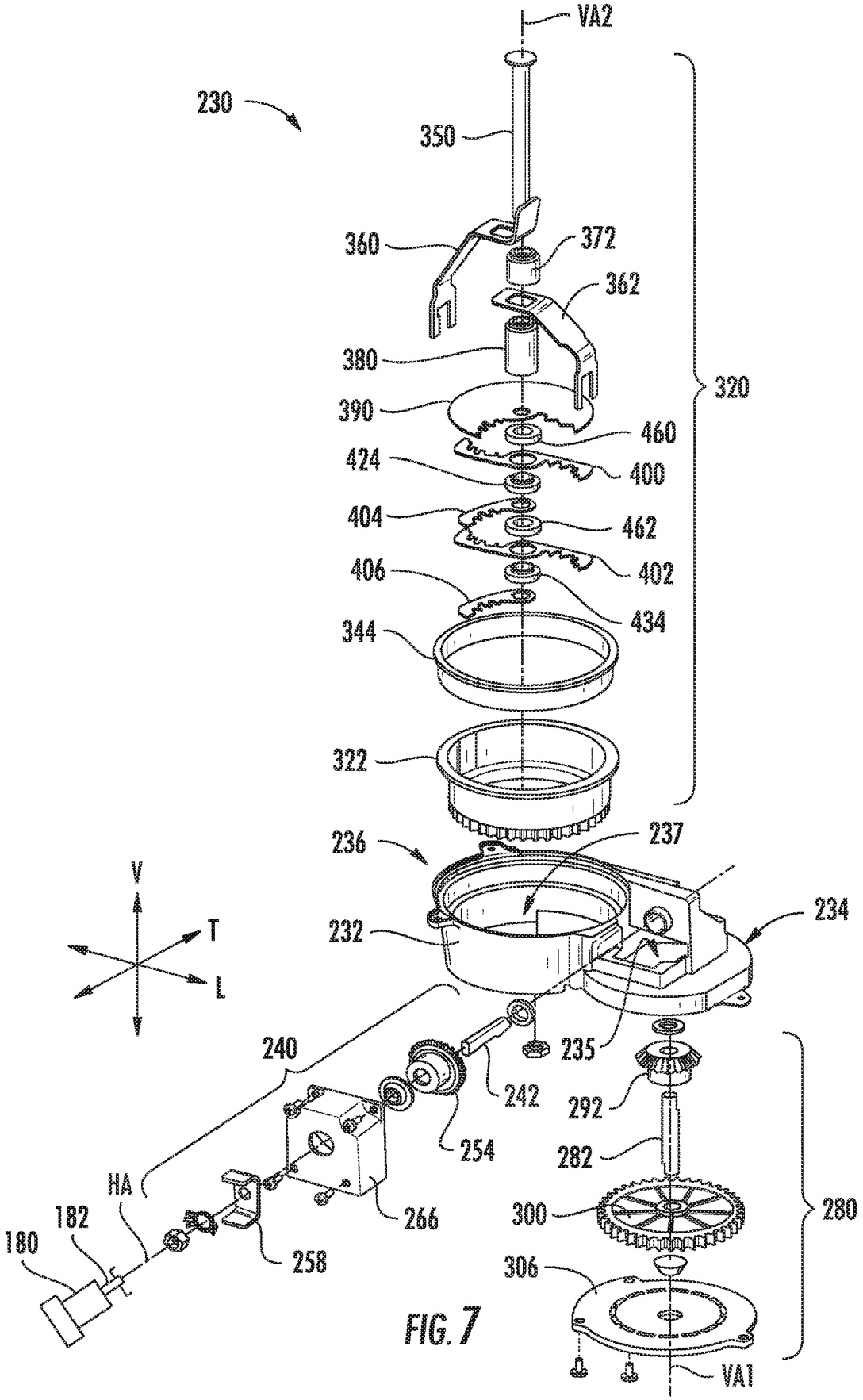
FIG. 7 provides an exploded view of the ice dispenser and crusher mechanism of FIG. 5.
Figure 8:
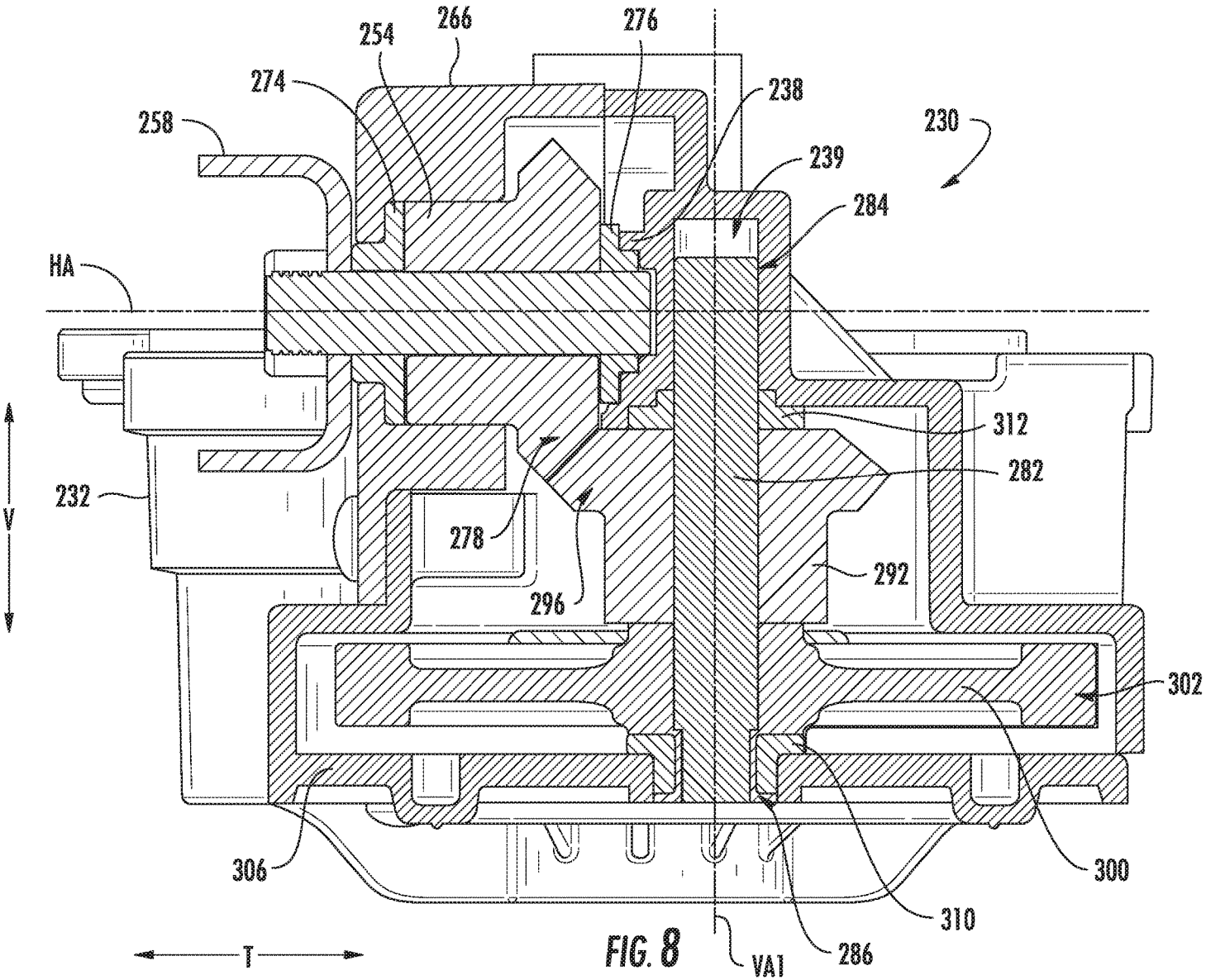
FIG. 8 provides a side cross sectional view of the ice dispenser and crusher mechanism of FIG. 5.
Figure 9:
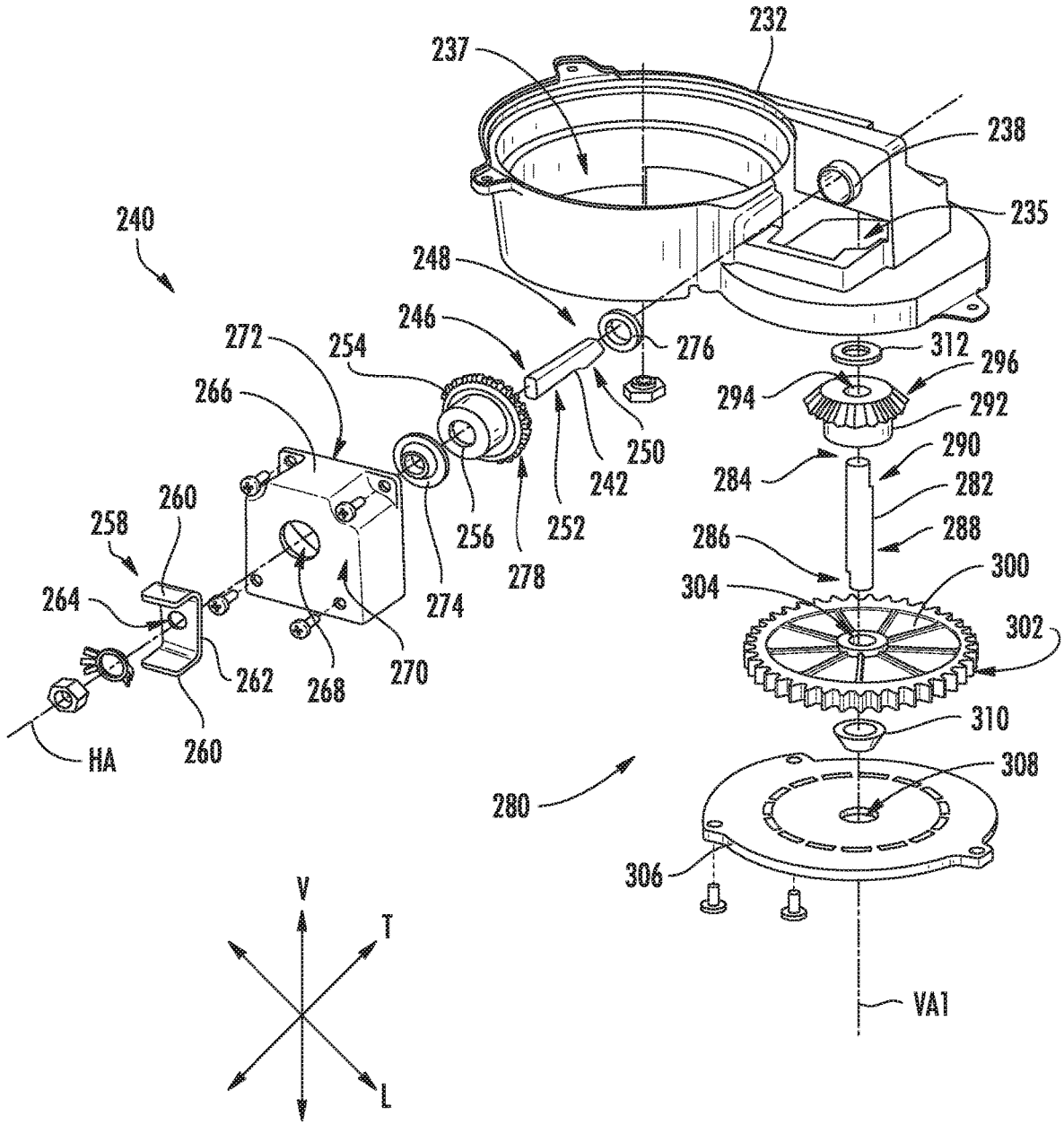
FIG. 9 provides a close up, exploded view of a horizontal coupling assembly and a vertical drive assembly of the dispenser crusher mechanism.
Figure 10:
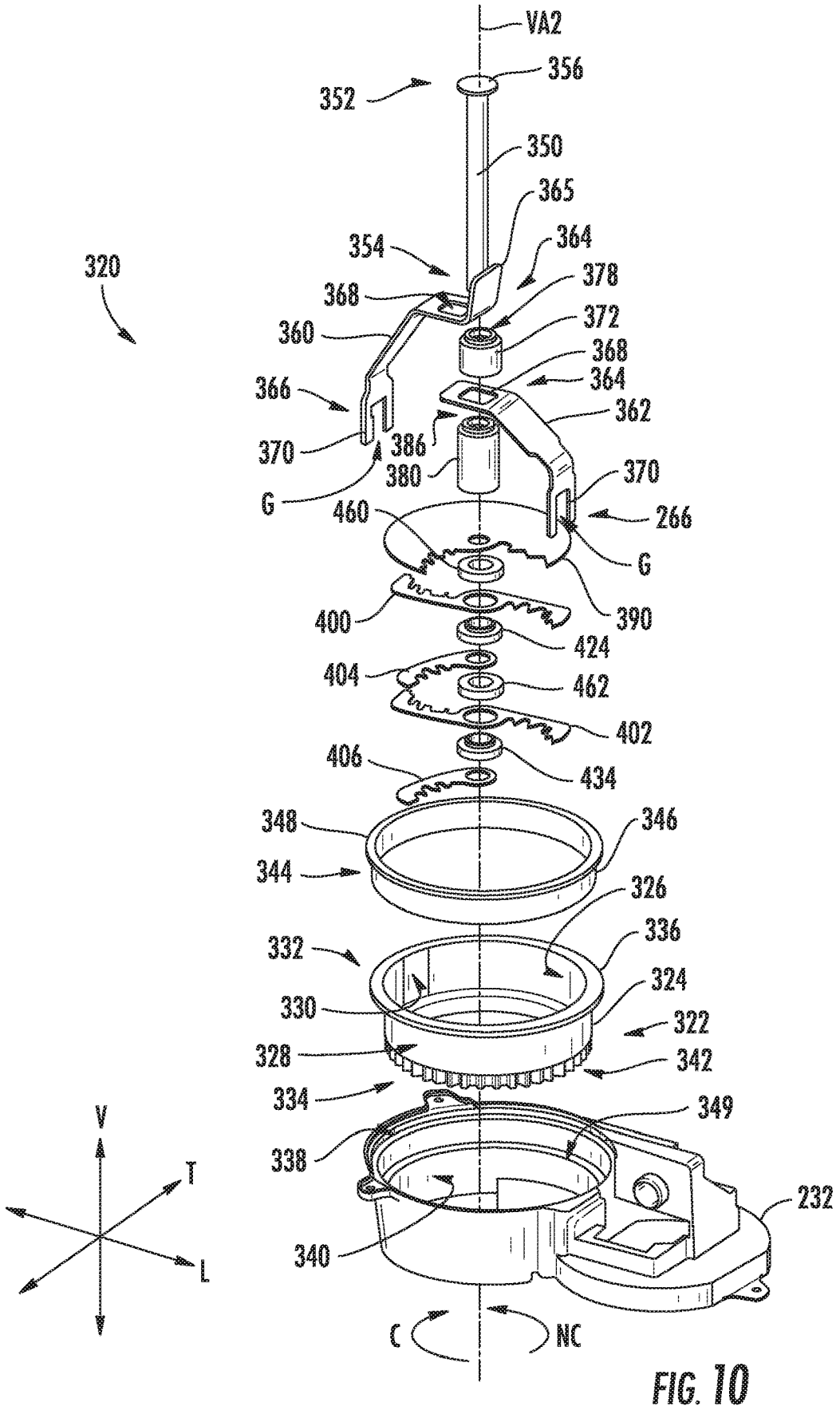
FIG. 10 provides a close up, exploded view of a drum assembly of the dispenser crusher mechanism.
Figure 11:
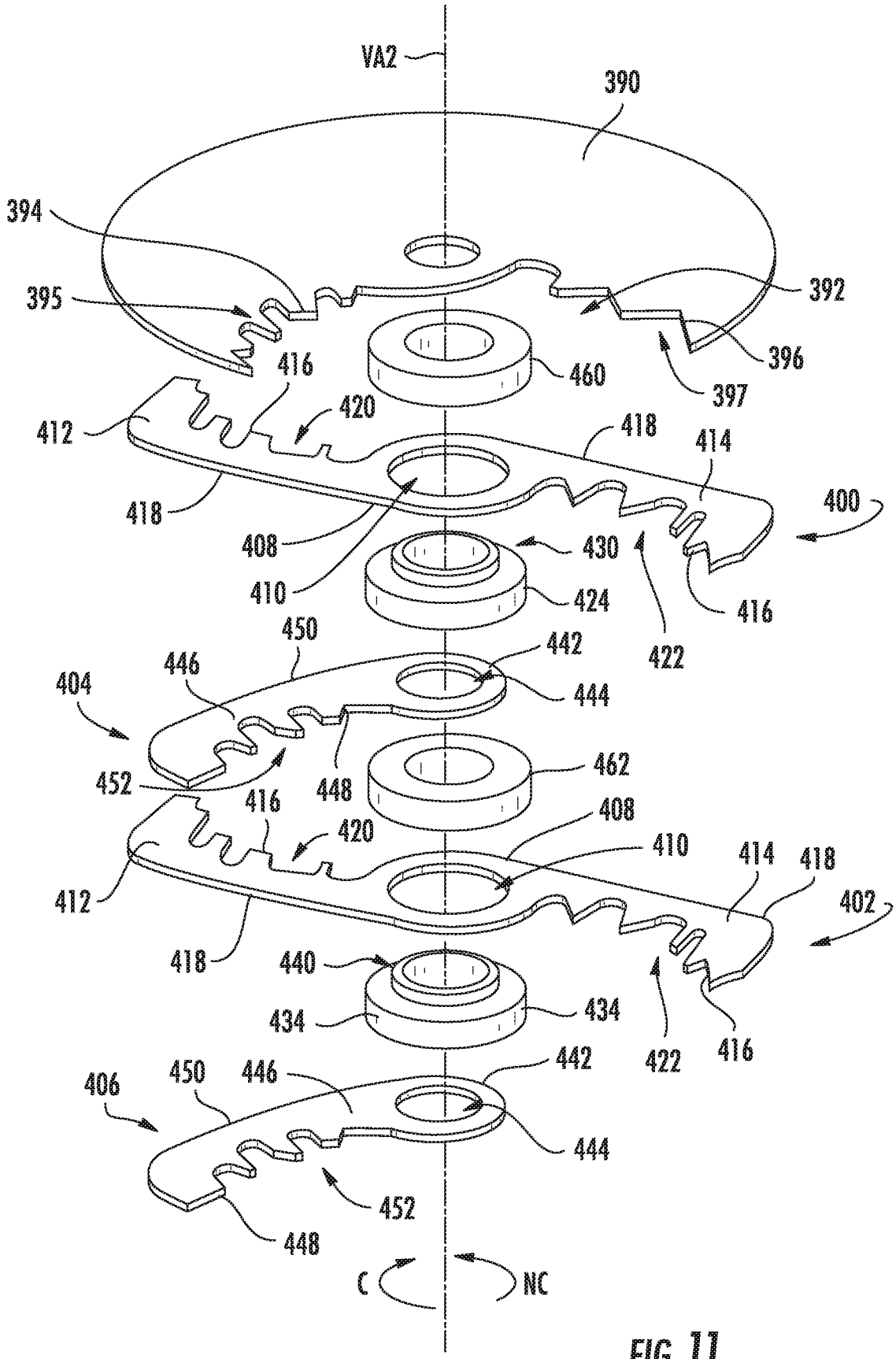
FIG. 11 provides a close up, exploded view of a blade assembly of dispenser crusher mechanism.
Figure 12:
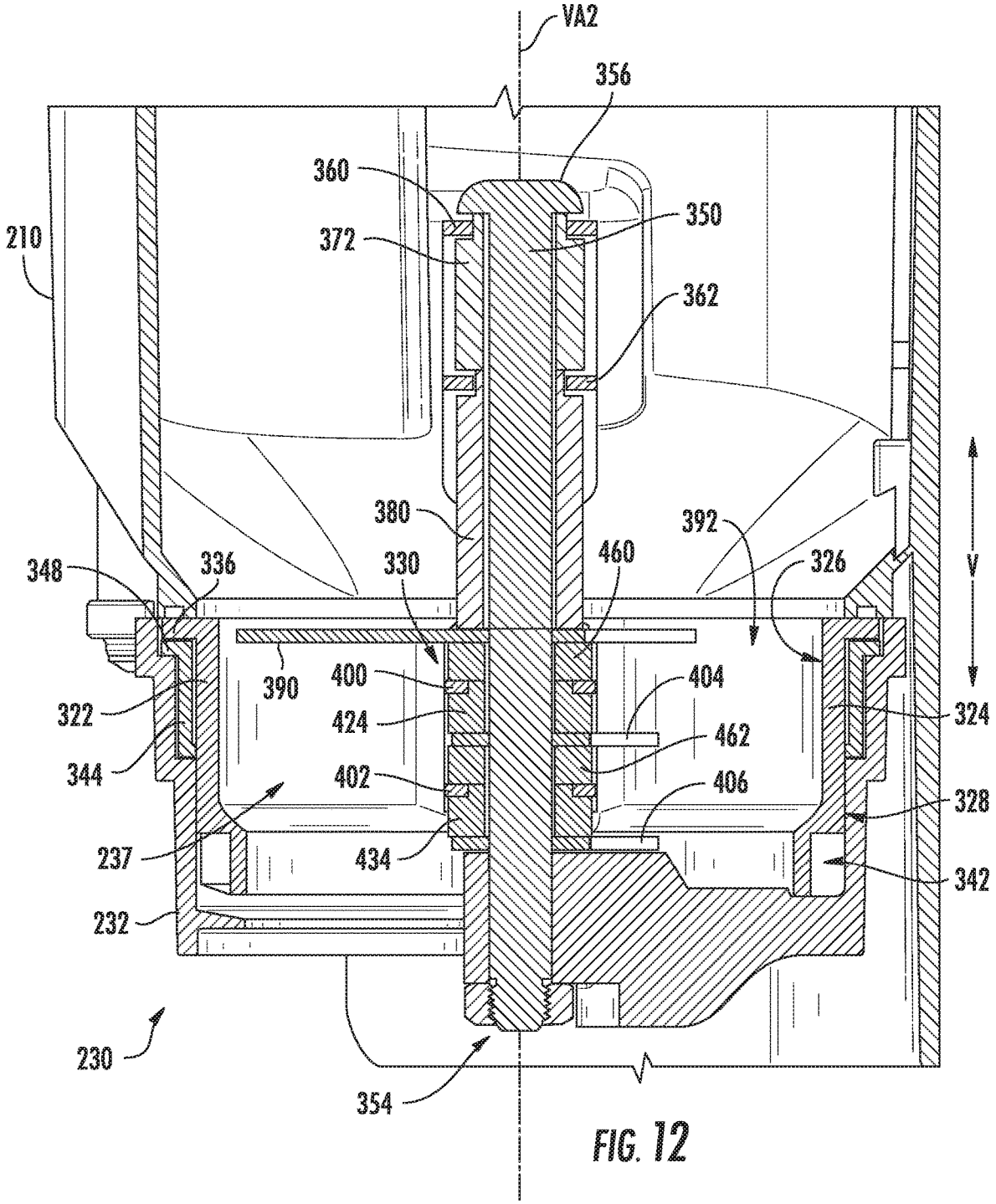
FIG. 12 provides a cross sectional view through a second portion of a housing of the dispenser crusher mechanism.

FIGS. 5 through 12 provide various views of dispenser crusher mechanism 230. More particularly, FIG. 5 provides a rear perspective view of ice dispenser crusher mechanism 230. FIG. 6 provides a bottom perspective view of ice dispenser crusher mechanism 230. FIG. 7 provides an exploded view of ice dispenser crusher mechanism 230. FIG. 8 provides a side cross sectional view of dispenser crusher mechanism 230. FIG. 9 provides a close up, exploded view of a horizontal coupling assembly 240 and a vertical drive assembly 280 of dispenser crusher mechanism 230. FIG. 10 provides a close up, exploded view of a drum assembly 320 of dispenser crusher mechanism 230. FIG. 11 provides a close up, exploded view of a blade assembly of dispenser crusher mechanism 230. FIG. 12 provides a cross sectional view through a second portion 236 of a housing 232 of dispenser crusher mechanism 230.

As shown, dispenser crusher mechanism 230 includes a housing 232. Housing 232 is a structural component that holds or contains drum assembly 320 and various other drive components of horizontal coupling assembly 240 and vertical drive assembly 280. In particular, housing 232 has a first portion 234 and second portion 236. First portion 234 of housing 232 defines a first chamber 235 and second portion 236 defines a second chamber 237. When dispenser crusher mechanism 230 is assembled, first chamber 235 receives drive components of vertical drive assembly 280 and various components of horizontal coupling assembly 240 are attached to or coupled with first portion 234 of housing 232. Further, when dispenser crusher mechanism 230 is assembled, second chamber 237 receives various components of drum assembly 320. As best shown in FIG. 6, first chamber 235 and second chamber 237 are contiguous with one another in this example embodiment. In addition, the second chamber 237 is in communication with opening 218 of ice bucket 210 for receipt of ice as best shown in FIG. 4.

As shown in FIGS. 7 and 9, horizontal coupling assembly 240 of dispenser crusher mechanism 230 defines a horizontal axis HA. For this embodiment, the horizontal axis HA is orthogonal to the vertical direction V. That is, the horizontal axis HA may extend along the lateral direction L, the transverse direction T, or both. In this example, the horizontal axis HA extends along the transverse direction T. Horizontal coupling assembly 240 is operatively coupled with a drive motor 180 (FIG. 7), such as e.g., a drive motor of refrigerator appliance 100 of FIGS. 1 and 2 or some other appliance in which ice dispensing assembly 200 is mounted. For this embodiment, drive motor 180 is a horizontal axis drive motor. Stated differently, output shaft 182 of drive motor 180 extends along and is rotatable about the horizontal axis HA. As will be explained in greater detail below, horizontal coupling assembly 240 is configured to receive rotational energy or motion from drive motor 180, transmit the rotational energy approximately ninety degrees (90°) to drive components of vertical drive assembly 280, and vertical drive assembly 280 drives the drum assembly 320 to rotate about the vertical direction V to dispense ice, and in some instances, crush the ice as well.

Horizontal coupling assembly 240 includes a horizontal shaft 242 rotatable about the horizontal axis HA. Horizontal shaft 242 extends between a first end 246 and a second end 248, e.g., along the horizontal axis HA. Horizontal shaft 242 may be formed of any suitable material, such as e.g., metal. For this embodiment, horizontal shaft 242 includes a circular portion 250 and a noncircular portion 252 each extending along a portion of the horizontal length of horizontal shaft 242. More particularly, for this embodiment, the noncircular portion 252 of horizontal shaft 242 has a hexagonal cross section when viewed along the horizontal axis HA. Noncircular portion 252 of horizontal shaft 242 is received through an opening 256 of a horizontal transmission gear 254 mounted to horizontal shaft 242. Thus, horizontal shaft 242 and horizontal transmission gear 254 are coupled, and accordingly, as horizontal shaft 242 is rotated about the horizontal axis HA, horizontal transmission gear 254 is likewise rotated about the horizontal axis HA. Circular portion 250 of horizontal shaft 242 may extend along the remaining horizontal length of horizontal shaft 242. In alternative example embodiments, horizontal transmission gear 254 may be integrally formed with horizontal shaft 242. For instance, horizontal transmission gear 254 and horizontal shaft 242 may be additively printed as a single, continuous piece.

Horizontal transmission gear 254 may be any suitable type of gear capable of changing the transmission direction of rotational energy, e.g., a ninety degree (90°) change in direction. For instance, horizontal transmission gear 254 may be a bevel gear in some embodiments. In particular, for this example embodiment, horizontal transmission gear 254 is a miter gear. Teeth 278 of horizontal transmission gear 254 may have any suitable geometry, such as e.g., straight, spiral, zerol, hypoid, or other suitable geometries. Further, as noted above, in some embodiments, horizontal transmission gear 254 defines opening 256 extending therethrough, as noted above. In embodiments where horizontal shaft 242 has a noncircular portion configured to be received through opening 256, the cross section of opening 256 may have a geometry complementary to noncircular portion 252 of horizontal shaft 242. As one example, where noncircular portion 252 of horizontal shaft 242 has a hexagonal cross section as viewed along the horizontal axis HA, opening 256 of horizontal transmission gear 254 may likewise have a hexagon the cross section as viewed along the horizontal axis HA. In this way, opening 256 of horizontal transmission gear 254 may receive noncircular portion 252 of horizontal shaft 242 and such complementary coupling may further prevent horizontal transmission gear 254 from slipping about the horizontal axis HA relative to horizontal shaft 242, e.g., to prevent transmission losses.

Horizontal coupling assembly 240 also includes a coupling 258 received at first end 246 of horizontal shaft 242. Coupling 258 interfaces with a similarly-shaped coupling of drive motor 180 to mechanically couple drive motor 180 with dispenser crusher mechanism 230. Coupling 258 generally has a fork-like shape with a pair of side members 260 extending from a plate 262. Plate 262 of coupling 258 defines an opening 264 extending therethrough. Opening 264 of coupling 258 receives first end 246 of horizontal shaft 242 when dispenser crusher mechanism 230 is assembled. A nut and safety washer or other mechanical retention means may secure horizontal shaft 242 and coupling 258 in place and prevent translational movement along the horizontal axis HA.

A cover 266 secures horizontal coupling assembly 240 to first portion 234 of housing 232. More particularly, cover 266 secures horizontal coupling assembly 240 to first portion 234 of housing 232. Cover 266 has a rear surface 270 and an opposing front surface 272. Coupling 258 is secured to and seated flush against rear surface 270 by the nut and safety washer. Opening 264 of coupling 258 is aligned and in mating communication with an opening 268 defined by cover 266. In this way, horizontal shaft 242 may extend through opening 268 of cover 266 and opening 264 of coupling 258 when dispenser crusher mechanism is assembled. At front surface 272 of cover 266, an annular spacer 274 is disposed between and spaces cover 266 from horizontal transmission gear 254, e.g., along the horizontal axis HA. Annular spacer 274 spaces horizontal transmission gear 254 from cover 266 to prevent premature wear and to properly position horizontal transmission gear 254 along horizontal shaft 242. Another annular spacer 276 is disposed between horizontal transmission gear 254 and housing 232, e.g., along the horizontal axis HA. Notably, both annular spacers 274, 276 define openings that are sized to receive horizontal shaft 242 therethrough. A docking port 238 protrudes outward from first portion 234 of housing 232, e.g., along the horizontal axis HA. Docking port 238 is configured to receive annular spacer 276 and second end 248 of horizontal shaft 242. Docking port 238 secures second end 248 of horizontal shaft 242 and prevents translational movement of horizontal coupling assembly 240, e.g., along the horizontal axis HA.

As further shown, dispenser crusher mechanism 230 also includes vertical drive assembly 280, as noted above. Vertical drive assembly 280 is received within first chamber 235 of first portion 234 of housing 232. Further, vertical drive assembly 280 defines a first vertical axis VA1. For this embodiment, first vertical axis VA1 is orthogonal to the horizontal axis HA and extends along the vertical direction V. That is, first vertical axis VA1 is spaced ninety degrees (90°) from horizontal axis HA.

Vertical drive assembly 280 includes a vertical shaft 282 rotatable about the first vertical axis VA1. Vertical shaft 282 extends between a first end 284 and a second end 286, e.g., along the first vertical axis VA1. Vertical shaft 282 may be formed of any suitable material, such as e.g., metal. For this embodiment, vertical shaft 282 includes a circular portion 288 and a noncircular portion 290 each extending along a portion of the vertical length of vertical shaft 282. More particularly, for this embodiment, the noncircular portion 290 of vertical shaft 282 has a hexagonal cross section when viewed along the vertical axis VA1. Noncircular portion 290 of vertical shaft 282 is received through an opening 294 of a vertical transmission gear 292 mounted to vertical shaft 282. Thus, vertical shaft 282 and vertical transmission gear 292 are coupled, and accordingly, as vertical shaft 282 is rotated about the vertical axis VA1, vertical transmission gear 292 is likewise rotated about the vertical axis VA1. Circular portion 288 of vertical shaft 282 may extend along the remaining vertical length of vertical shaft 282. In alternative example embodiments, vertical transmission gear 292 may be integrally formed with vertical shaft 282. For instance, vertical transmission gear 292 and vertical shaft 282 may be additively printed as a single, continuous piece.

Vertical transmission gear 292 may be any suitable type of gear capable of meshing with horizontal transmission gear 254 to change the transmission direction of rotational energy, e.g., a ninety degree (90°) direction change. For instance, vertical transmission gear 292 may be a bevel gear in some embodiments. For this example embodiment, like horizontal transmission gear 254, vertical transmission gear 292 is a miter gear. Teeth 296 of vertical transmission gear 292 may have a geometry complementary to horizontal transmission gear 254, such as e.g., straight, spiral, zerol, hypoid, or other suitable geometries. Further, as noted above, in some embodiments, vertical transmission gear 292 defines opening 294 extending therethrough. In embodiments where vertical shaft 282 has a noncircular portion configured to be received through opening 294, the cross section of opening 294 may have a geometry complementary to noncircular portion 290 of vertical shaft 282. As one example, where noncircular portion 290 of vertical shaft 282 has a hexagonal cross section as viewed along the first vertical axis VA1, opening 294 of vertical transmission gear 292 may likewise have a hexagonal cross section as viewed along the first vertical axis VA1. In this way, opening 294 of vertical transmission gear 292 may receive noncircular portion 290 of vertical shaft 282 and such complementary coupling may further prevent vertical transmission gear 292 from slipping about the first vertical axis VA1 relative to vertical shaft 282, e.g., to prevent transmission losses.

As best shown in FIG. 8, vertical transmission gear 292 is in mechanical engagement with horizontal transmission gear 254 of horizontal coupling assembly 240. That is, the teeth 296 of vertical transmission gear 292 mesh with the teeth 278 of horizontal transmission gear 254. In this way, the rotational energy transmitted to horizontal transmission gear 254 from drive motor 180 via rotation of horizontal shaft 242 may be transmitted to vertical transmission gear 292. Accordingly, the meshing of horizontal transmission gear 254 and vertical transmission gear 292 provides a change in the transmission direction about ninety degrees (90°), e.g., from the horizontal axis HA to the first vertical axis VA1. As vertical transmission gear 292 is coupled with or integrally formed with vertical shaft 282, the transmission of rotational energy to vertical transmission gear 292 causes vertical shaft 282 to rotate about the first vertical axis VA1.

As shown particularly in FIGS. 7 and 8, vertical drive assembly 280 includes a drive gear 300 mounted to or integrally formed with vertical shaft 282. For this embodiment, drive gear 300 is a spur gear. In alternative exemplary embodiments, drive gear 300 may be another suitable type of gear capable of driving drum assembly 320. Drive gear 300 includes a plurality of teeth 302 and defines an opening 304 extending therethrough. For this embodiment, opening 304 has a noncircular cross section as viewed along the first vertical axis VA1. Accordingly, opening 304 is shaped complementary to and is configured to receive noncircular portion 290 of vertical shaft 282. In some exemplary embodiments, opening 304 has a hexagonal cross section as viewed along the first vertical axis VA1 and noncircular portion 290 of vertical shaft 282 has a hexagonal cross section as viewed along the first vertical axis VA1 that is shaped complementary to opening 304. The flat mating surfaces of the hexagonal shapes prevent slipping of drive gear 300 about first vertical axis VA1 relative to vertical shaft 282. In alternative example embodiments, drive gear 300 may be integrally formed with vertical shaft 282. For instance, drive gear 300 and vertical shaft 282 may be additively printed as a single, monolithic piece. In some exemplary embodiments, drive gear 300 and vertical transmission gear 292 are a single, monolithic component. For instance, drive gear 300 and vertical transmission gear 292 may be molded or cast as a single component.

Vertical drive assembly 280 further includes a cover bottom 306 that attaches to housing 232 and retains vertical drive assembly 280 within first chamber 235 of first portion 234 of housing 232, e.g., along the first vertical axis VA1. Cover bottom 306 defines an opening 308 centered on the first vertical axis VA1. As depicted in FIG. 8, an annular spacer 310 is received within opening 308 and spaces drive gear 300 from cover bottom 306, e.g., along the first vertical axis VA1. Annular spacer 310 defines an opening sized to receive vertical shaft 282 therethrough, and more particularly, the bottom or second end 286 of vertical shaft 282.

As further depicted in FIG. 8, a shaft recess 239 is defined by housing 232 and is configured to receive a portion of vertical shaft 282, and more particularly, the top or first end 284 of vertical shaft 282. An annular spacer 312 is positioned between and spaces vertical transmission gear 292 from housing 232, e.g., along the first vertical axis VA1. Annular spacer 312 prevents vertical transmission gear 292 from rubbing against housing 232. Annular spacer 312 defines an opening sized to receive vertical shaft 282 therethrough, and more particularly, the top or first end 284 of vertical shaft 282 so that vertical shaft 282 may be received within shaft recess 239.

As shown best in FIG. 7, drum assembly 320 of dispenser crusher mechanism 230 is operatively configured for dispensing or moving ice from ice bucket 210 (FIG. 4) to a chute or other passageway so that ice may ultimately be discharged for consumer use. Drum assembly 320 also may, at the direction of a user, crush ice as it is urged through drum assembly 320. Drum assembly 320 is received within second chamber 237 of second portion 236 of housing 232. Drum assembly 320 defines a second vertical axis VA2. For this embodiment, second vertical axis VA2 is orthogonal to the horizontal axis HA and extends along the vertical direction V. In particular, second vertical axis VA2 extends parallel to first vertical axis VA1, e.g., along a direction orthogonal to the vertical direction V.

As shown best in FIGS. 10 and 12, drum assembly 320 includes a drum 322 rotatable about the second vertical axis VA2. When dispenser crusher mechanism 230 is assembled, drum 322 is received within second chamber 237 defined by second portion 236 of housing 232. Drum 322 has a generally annular shape and has a wall 324 that extends circumferentially about the second vertical axis VA2. Wall 324 has an inner surface 326 and an opposing outer surface 328. Inner surface 326 defines a pair of opposed notches 330 that each receive a bridge, as will be described further below. Further, drum 322 extends between a top portion 332 and a bottom portion 334, e.g., along the second vertical axis VA2. Drum 322 includes a flange 336 that extends outward from wall 324 and circumferentially about top portion 332 of drum 322. Flange 336 of drum 322 is seated on a flange 348 of a bearing guide 344 that is in turn seated on a recessed edge 338 defined along an inner surface 340 of housing 232. Recessed edge 338 is circumferentially disposed about second portion 236 of housing 232. Drum 322 includes a plurality of gear teeth 342 circumferentially disposed along its bottom portion 334. The gear teeth 342 extend radially outward from outer surface 328 of drum 322. As shown in FIG. 6, drum 322 is in mechanical engagement with drive gear 300 of vertical drive assembly 280 (cover bottom 306 is removed for illustrative purposes). In particular, the plurality of gear teeth 342 of drum 322 are mechanically engaged (i.e., mesh) with the gear teeth 302 of drive gear 300.

Drum assembly 320 also includes bearing guide 344 that guides the rotational motion of drum 322 about the second vertical axis VA2. When dispenser crusher mechanism 230 is assembled, bearing guide 344 is disposed between outer surface 328 of drum 322 and inner surface 340 of housing 232. Bearing guide 344 has a generally annular shape and has a wall 346 that extends circumferentially about the second vertical axis VA2. Bearing guide 344 includes a flange 348 extending radially outward from wall 346 and circumferentially about its top portion. Flange 348 is seated on recessed edge 338 defined along inner surface 340 of housing 232. Recessed edge 338 is circumferentially disposed about second portion 236 of housing 232. A bottom portion of wall 346 is positioned proximate an annular flange 349 (FIG. 10) defined by inner surface 340 of housing 232.

With reference to FIGS. 10 and 12, drum assembly 320 further includes various components that facilitate moving ice through dispenser crusher mechanism 230 and crush the ice passing therethrough (if selected by a user). As shown, drum assembly 320 includes a main shaft 350 that extends along the second vertical axis VA2. For this embodiment, main shaft 350 does not rotate about second vertical axis VA2. That is, main shaft 350 is a stationary shaft. Main shaft 350 may be any suitable noncircular shape that impedes rotation of components attached thereto. For instance, for this exemplary embodiment, main shaft 350 has a hexagonal cross section as viewed along the second vertical axis VA2. Main shaft 350 extends between a top end 352 and a bottom end 354, e.g., along the second vertical axis VA2. Top end 352 includes a head 356 that has a larger diameter than the remaining portion or shank of main shaft 350. Head 356 of main shaft 350 constrains the movement of main shaft 350, e.g., along the second vertical axis VA2.

Drum assembly 320 also includes a bridge assembly. For this embodiment, bridge assembly includes an upper bridge 360 and a lower bridge 362. In alternative embodiments, bridge assembly may have more than two (2) bridges, such as e.g., four (4) separate bridges each spaced ninety degrees (90°) from one another about the second vertical axis VA2. Generally, upper and lower bridges 360, 362 are configured to stir the ice within ice dispensing assembly 200, e.g., within bottom portion 216 of ice bucket 210 and within dispenser crusher mechanism 230. Accordingly, upper and lower bridges 360, 362 extend into cavity 212 of ice bucket 210 when dispenser crusher mechanism 230 is attached to ice bucket 210. Upper and lower bridges 360, 362 are also configured to drive rotating blades of drum assembly 320 as will be described further below. Further, for this embodiment, upper bridge 360 and lower bridge 362 are separate pieces. In this way, the bridges or bridge components may be easier to manufacturer and assemble, e.g., than bridge assemblies with single span bridge components. For instance, by separating upper and lower bridges 360, 362 into separate pieces instead of a single span, the dimensional tolerances of the bridges 360, 362 can be increased. Moreover, as upper and lower bridges 360, 362 are separate components, upper and lower bridges 360 may be spaced from one another, e.g., along the vertical direction V. The vertical spacing allows the agitation of the ice within cavity 212 of ice bucket 210 over a larger vertical height.

Upper bridge 360 and lower bridge 362 each extend between a proximal end 364 and a distal end 366. Upper and lower bridges 360, 362 each define a guide hole 368 at their respective proximal ends 364. The guide holes 368 of upper and lower bridges 360, 362 are sized to receive main shaft 350. Unlike lower bridge 362, upper bridge 360 includes an extension portion 365 that extends upward along the vertical direction V. Extension portion 365 provides additional agitation of ice within cavity 212 of ice bucket 210 (FIGS. 3 and 4), e.g., as it extends the vertical height at which ice is agitated within ice bucket 210. From their respective proximal ends 364, upper and lower bridges 360, 362 each project outward away from the second vertical axis VA2. At their respective distal ends 366, upper and lower bridges 360, 362 each include prongs 370 that extend generally along the vertical direction V. For this example, a space or gap is defined G is defined between prongs 370. Further, upper and lower bridges 360, 362 are each carried by drum 322 and thus are each rotatable about the second vertical axis VA2. In particular, upper and lower bridges 360, 362 are connected to drum 322 at opposing ends of inner surface 326 of drum 322, and accordingly, upper bridge 360 is opposed to lower bridge 362 by one hundred eighty degrees (180°) about the second vertical axis VA2. More particularly, upper and lower bridges 360, 362 are received within opposing notches 330 defined by inner surface 326 of drum 322. More particularly still, prongs 370 of upper and lower bridges 360, 362 are received within notches 330. Prongs 370 of upper and lower bridges 360, 362 also interface with rotating blades and are configured to drive upper and lower bridges 360, 362 about the second vertical axis VA2. That is, as drum 322 drives upper and lower bridges 360, 362 about the second vertical axis VA2, prongs 370 of upper and lower bridges 360, 362 drive rotating blades about the second vertical axis VA2 as well, e.g., to urge or motivate ice through dispenser crusher mechanism 230, and in some instances, crush the ice passing therethrough.

An upper bridge spacer 372 is mounted to main shaft 350 and is disposed between and spaces upper bridge 360 from lower bridge 362, e.g., along the second vertical axis VA2. Upper bridge spacer 372 extends between a top portion and a bottom portion, e.g., along the second vertical axis VA2. At top portion, upper bridge spacer 372 includes a rounded portion 378 that provides a bearing surface upon which upper bridge 360 may rotate about the second vertical axis VA2 when driven by drum 322. In this way, upper bridge spacer 372 couples upper bridge 360 with main shaft 350 but yet allows upper bridge 360 to rotate. Moreover, upper bridge spacer 372 defines an opening such that main shaft 350 may extend therethrough.

A lower bridge spacer 380 is mounted to main shaft 350 and is disposed between and spaces lower bridge 362 from a metering or top plate 390, e.g., along the second vertical axis VA2. Lower bridge spacer 380 has a greater vertical length than upper bridge spacer 372. Further, lower bridge spacer 380 extends between a top portion and a bottom portion, e.g., along the second vertical axis VA2. Like upper bridge spacer 372, lower bridge spacer 380 includes a rounded portion 386 at its top portion. Rounded portion 386 provides a bearing surface upon which lower bridge 362 may rotate about the second vertical axis VA2 when driven by drum 322. In this manner, lower bridge spacer 380 couples lower bridge 362 with main shaft 350 but yet allows lower bridge 362 to rotate. In addition, lower bridge spacer 380 defines an opening such that main shaft 350 may extend therethrough.

Generally, top plate 390 meters or controls the flow of ice from ice bucket 210 into dispenser crusher mechanism 230. Top plate 390 is mounted to main shaft 350 between the bridge assembly and a blade assembly of drum assembly 320, e.g., along the second vertical axis VA2. Top plate 390 does not rotate about the second vertical axis VA2 with drum 322. Top plate 390 may be formed of any suitable material. For instance, for this embodiment, top plate 390 is formed of metal. Top plate 390 has an outer diameter that is less than an inner diameter of drum 322. As shown, top plate 390 defines an opening or aperture 392 through which ice may pass in order to move through dispenser crusher mechanism 230. As such, aperture 392 can be sized to provide the desired flow rate of ice from container ice bucket 210. A first edge 394 and a second edge 396 of top plate 390 that form aperture 392 each have a plurality of teeth 395, 397, respectively. The teeth 395 of first edge 394 and the teeth 397 of second edge 396 face inward toward one another. Stated differently, the teeth 395, 397 of the first edge 394 and the second edge 396 each face towards aperture 392. In this way, no matter the direction of rotation in which drum 322 is rotated about the second vertical axis VA2, the teeth 395 of first edge 394 or the teeth 397 of second edge 396 may help crush ice as drum 322 rotates so as to prevent jams.

With reference now to FIGS. 10, 11, and 12, drum assembly 320 also includes a blade assembly, including rotating blades and non-rotating blades. For this embodiment, dispenser crusher mechanism 230 includes an upper rotating blade 400, a lower rotating blade 402, an upper non-rotating blade 404, and a lower non-rotating blade 406. Each of the rotating blades 400, 402 and non-rotating blades 404, 406 are coupled with main shaft 350. Rotating blades 400, 402 are rotatable about the second vertical axis VA2 and non-rotating blades 404, 406 are not rotatable about the second vertical axis VA2. Generally, prongs 370 of upper and lower bridges 360, 362 interface with respective upper and lower rotating blades 400, 402 to drive the rotating blades 400, 402 about the second vertical axis VA2, e.g., when drum 322 drives bridges 360, 362 about the second vertical axis VA2. More particularly, upper and lower rotating blades 400, 402 may each be disposed within gaps G defined between prongs 370 of upper and lower bridges 360, 362.

Upper and lower rotating blades 400, 402 are configured similarly to one another. In particular, upper and lower rotating blades 400, 402 each include a central portion 408. The central portion 408 of each rotating blade 400, 402 defines an opening 410 having a circular shape or cross section as viewed along the second vertical axis VA2. Upper and lower rotating blades 400, 402 each include a first wing 412 and a second wing 414 extending from their respective central portions 408. Second wing 414 extends opposite first wing 412 from central portion 408. The first and second wing 412, 414 of both upper and lower rotating blade 400, 402 include a first edge 416 and an opposing second edge 418. For each rotating blade 400, 402, a plurality of teeth 420 are defined along first edge 416 of first wing 412 and a plurality of teeth 422 are defined along first edge 416 of second wing 414 such that the teeth 420 of first wing 412 and teeth 422 of second wing 414 extend opposite one another, e.g., along a direction orthogonal to the vertical direction V. The second edges 418 of first wing 412 and second wing 414 of each rotating blade 400, 402 do not include teeth; rather the second edge 418 of first wing 412 and the second edge 418 of second wing 414 of each rotating blade 400, 402 is a flat edge.

An upper rotating blade spacer 424 is mounted to main shaft 350 and is disposed between and spaces upper rotating blade 400 from upper non-rotating blade 404, e.g., along the second vertical axis VA2. Upper rotating blade spacer 424 extends between a top portion and a bottom portion, e.g., along the second vertical axis VA2. At the top portion, upper rotating blade spacer 424 includes a rounded portion 430 that provides a bearing surface upon which upper rotating blade 400 may rotate about the second vertical axis VA2 when driven by one of bridges 360, 362. In this way, upper rotating blade spacer 424 couples upper rotating blade 400 with main shaft 350 but yet allows upper rotating blade 400 to rotate. Moreover, upper rotating blade spacer 424 defines an opening such that main shaft 350 may extend therethrough.

A lower rotating blade spacer 434 is mounted to main shaft 350 and is disposed between and spaces lower rotating blade 402 from lower non-rotating blade 406, e.g., along the second vertical axis VA2. Lower rotating blade spacer 434 extends between a top portion and a bottom portion, e.g., along the second vertical axis VA2. At the top portion, lower rotating blade spacer 434 includes a rounded portion 440 that provides a bearing surface upon which lower rotating blade 434 may rotate about the second vertical axis VA2 when driven by one of bridges 360, 362. In this way, lower rotating blade spacer 434 couples lower rotating blade 402 with main shaft 350 but yet allows lower rotating blade 402 to rotate. Moreover, lower rotating blade spacer 434 defines an opening such that main shaft 350 may extend therethrough.

Upper and lower non-rotating blades 404, 406 are configured similarly to one another. In particular, upper and lower non-rotating blades 404, 406 each include a central portion 442. The central portion 442 of each non-rotating blade 404, 406 defines an opening 444 having a noncircular cross section as viewed along the second vertical axis VA2. The cross sections of the noncircular openings 444 may have complementary geometries to the cross section of main shaft 350 as viewed along the second vertical axis VA2. Upper and lower non-rotating blades 404, 406 each include a wing 446 extending from their respective central portions 442. The wings 446 of both upper and lower non-rotating blades 404, 406 include a first edge 448 and an opposing second edge 450. For each non-rotating blade 404, 406, a plurality of teeth 452 are defined along first edge 448 of wing 446. Second edge 450 of the wings 446 of each non-rotating blade 404, 406 does not include teeth; rather the second edge 450 of wing 446 of each non-rotating blade 404, 406 is a flat edge. Notably, during an ice crushing operation, rotation of drum 322 in the direction of arrow C, which denotes a crushing operation direction, moves the teeth 420, 422 of rotating blades 400, 402 towards the teeth 452 of non-rotating blades 404, 406. Accordingly, ice delivered into dispenser crusher mechanism 230 from ice bucket 210 will be crushed between teeth 420, 422 and teeth 452 to provide crushed ice to the user. Conversely, by rotating drum 322 in the direction of arrow NC, which denotes a non-crushing operation direction, the teeth 420, 422 of rotating blades 400, 402 will be moved away from teeth 452 of non-rotating blades 404, 406. As such, ice delivered into drum 322 from ice bucket 210 will not be crushed so that whole or full-sized ice can be delivered to the user.

Further, as shown in FIG. 7, an upper non-rotating blade spacer 460 is mounted to main shaft 350 and is disposed between and spaces top plate 390 from upper rotating blade 400, e.g., along the second vertical axis VA2. Upper non-rotating blade spacer 460 defines an opening such that main shaft 350 may extend therethrough. In addition, as further shown in FIG. 7, a lower non-rotating blade spacer 462 is mounted to main shaft 350 and is disposed between and spaces upper non-rotating blade 404 from lower rotating blade 402, e.g., along the second vertical axis VA2. Lower non-rotating blade spacer 462 defines an opening such that main shaft 350 may extend therethrough.

Dispenser crusher mechanism 230 may dispense ice and perform an ice crushing operation as follows. Upon user selection of crushed ice, e.g., by manipulating one or more input selectors of user interface panel 138 or refrigerator appliance 100, controller 150 activates drive motor 180. Output shaft 182 of drive motor 180 rotates about the horizontal axis HA. A coupling mounted to or carried by output shaft 182 of drive motor 180 couples coupling 258 of horizontal coupling assembly 240. As output shaft 182 of drive motor 180 rotates about the horizontal axis HA, the coupling of drive motor 180 transmits rotational energy to coupling 258. As coupling 258 is driven about the horizontal axis HA, horizontal shaft 242 coupled thereto likewise rotates about the horizontal axis HA. Horizontal transmission gear 254 mounted to or integrally formed with horizontal shaft 242 rotates in unison with horizontal shaft 242 about the horizontal axis HA. Horizontal transmission gear 254 is in mechanical engagement with vertical transmission gear 292 oriented on first vertical axis VA1. The meshing interface between horizontal transmission gear 254 transmits the rotational energy from or along the horizontal axis HA to the first vertical axis VA1, causing vertical transmission gear 292 to rotate about the first vertical axis VA1.

Vertical transmission gear 292 is mounted to or integrally formed with vertical shaft 282. Accordingly, when vertical transmission gear 292 is rotated about the first vertical axis VA1, vertical shaft 282 is likewise rotated about the first vertical axis VA1. Drive gear 300 is mounted to or integrally formed with vertical shaft 282, and thus, drive gear 300 rotates about the first vertical axis VA1 in unison with vertical shaft 282. Teeth 302 of drive gear 300 are in mechanical engagement with teeth 342 of drum 322 to drive drum 322 about the second vertical axis VA2. Thus, drum 322 is rotatable about second vertical axis VA2. As drum 322 is rotated about the second vertical axis VA2, upper and lower bridges 360, 362 carried by drum 322 are likewise rotated about the second vertical axis VA2. Rotation of upper and lower bridges 360, 362 stirs or agitates ice within bottom portion 216 of ice bucket 210 and urges or motivates the ice through aperture 392 of top plate 390. Teeth 395, 397 of top plate 390 breakup the ice moving through aperture 392 and prevent jams. The ice moves into second chamber 237 where the blade assembly crushes the ice. In particular, upper and lower bridges 360, 362 drive upper rotating blade 400 and lower rotating blade 402 about the second vertical axis VA2. As upper and lower rotating blades 400, 402 are rotated about the second vertical axis VA2, the ice passing through dispenser crusher mechanism 230 is crushed between teeth 420, 422 of rotating blades 400, 402 and teeth 452 of upper and lower non-rotating blades 404, 406. The crushed ice exits through a bottom opening of dispenser crusher mechanism 230 and proceeds into a chute or other delivery conduit and ultimately to discharging outlet 134 or another suitable outlet of refrigerator appliance 100. Notably, in a crushed ice operation, drum 322 is rotated about the second vertical axis VA2 in a direction C. If a non-crushing operation is selected by a user, drum 322 is rotated about the second vertical axis VA2 in a direction opposite the direction C, which is a direction denoted as NC for non-crushed operation. To change the direction of rotation of drum 322 about the second vertical axis VA2, output shaft 182 of drive motor 180 is rotated about the horizontal axis HA in a different direction.

Dispenser crusher mechanism 230 may dispense ice in a non-ice crushing operation in a similar manner as ice is dispensed in the ice crushing operation described above except that drum 322 is rotated about the second vertical axis VA2 in the NC direction. Accordingly, when rotating blades 400, 402 are rotated about the second vertical axis VA2, the flat edges of the first wings 412 and second wings 414 of upper and lower rotating blades 400, 402 interface with the ice and motivate the ice downward through second chamber 237 without the teeth 420, 422 of rotating blades 400, 402 crushing the ice against the teeth 452 of non-rotating blades 404, 406. In this way, the ice is dispensed through dispenser crusher mechanism 230 without being crushed.

The construction of dispenser crusher mechanism 230 described above provides a horizontal axis motor coupling with a vertical axis agitator and crusher for dispensing and crushing ice. Such construction allows for drive motor 180 to be positioned at or above ice opening 218 of ice bucket 210. Accordingly, there is less risk of water leaking into drive motor 180. Further, with the construction of dispenser crusher mechanism 230 noted above, there is no need for a gear reduction between the drive motor and drum 322, and thus, a custom motor or gear reduction gear train is not needed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly for an appliance, the ice dispensing assembly comprising:

an ice bucket defining a cavity for stowing ice and defining an opening;

a dispenser crusher mechanism, comprising:

a housing defining a first chamber and a second chamber, the second chamber in communication with the opening of the ice bucket for receipt of ice;

a horizontal coupling assembly defining a horizontal axis and operatively coupled with a drive motor along the horizontal axis, the horizontal coupling assembly comprising:

a horizontal shaft rotatable about the horizontal axis;

a horizontal transmission gear mounted to or integrally formed with the horizontal shaft;

a vertical drive assembly received within the first chamber of the housing and defining a first vertical axis, the vertical drive assembly comprising:

a vertical shaft rotatable about the first vertical axis;

a vertical transmission gear mounted to or integrally formed with the vertical shaft and in mechanical engagement with the horizontal transmission gear of the horizontal coupling assembly;

a drive gear mounted to or integrally formed with the vertical shaft;

a drum assembly defining a second vertical axis, the drum assembly comprising:

a drum received within the second chamber and rotatable about the second vertical axis, the drum in mechanical engagement with the drive gear;

an upper bridge carried by the drum and rotatable about the second vertical axis;

a lower bridge carried by the drum and rotatable about the second vertical axis;

a main shaft extending along the second vertical axis, the upper and lower bridges each coupled with the main shaft;

at least one rotating blade coupled with the main shaft and with the upper and lower bridges, the upper and lower bridges configured to rotate the at least one rotating blade about the second vertical axis; and at least one non-rotating blade coupled with the main shaft.

2. The ice dispensing assembly of claim 1, wherein the drum extends between a top portion and a bottom portion, and wherein the drum comprises a plurality of gear teeth circumferentially disposed along the bottom portion of the drum, the plurality of gear teeth in mechanical engagement with a plurality of gear teeth of the drive gear.

3. The ice dispensing assembly of claim 1, further comprising:

a bridge spacer disposed between and spacing the upper bridge from the lower bridge along the second vertical axis.

4. The ice dispensing assembly of claim 3, wherein the bridge spacer is coupled with the main shaft, and wherein the bridge spacer comprises a rounded portion that provides a bearing surface upon which the upper bridge is rotatable about the second vertical axis.

5. The ice dispensing assembly of claim 1, wherein the horizontal transmission gear and the vertical transmission gear are both bevel gears.

6. The ice dispensing assembly of claim 1, wherein the main shaft has a noncircular cross section when viewed along the second vertical axis and is a stationary shaft.

7. The ice dispensing assembly of claim 1, further comprising:

a top plate attached to the main shaft, the top plate having an outer diameter less than an inner diameter of the drum, the top plate defining an aperture formed at least in part by a first edge and a second edge, and wherein the top plate defines a plurality of teeth along the first edge and a plurality of teeth along the second edge of the aperture.

8. The ice dispensing assembly of claim 1, wherein the drum comprises an annular wall having an inner surface and an opposing outer surface, the inner surface defining opposed notches, and wherein the upper and lower bridges are received within the opposed notches.

9. The ice dispensing assembly of claim 1, wherein the drive motor causes the drum to rotate about the second vertical axis in one direction for crushed ice and to rotate about the second vertical axis in an opposite direction for non-crushed ice.

10. The ice dispensing assembly of claim 1, wherein the at least one rotatable blade comprises a first wing and a second wing extending opposite the first wing, each wing comprising a first edge and a second edge, the at least one rotatable blade defining a plurality of teeth along the first edge of the first wing and the first edge of the second wing such that the teeth of the first wing and the teeth of the second wing extend in opposite directions.

11. The ice dispensing assembly of claim 1, wherein the at least one non-rotating blade comprises a first edge and a second edge, the at least one non-rotating blade defining a plurality of teeth along the second edge oriented such that ice is crushed between teeth of the rotating blade and the teeth of the non-rotating blade when the drum is rotating in a crushing direction.

12. The ice dispensing assembly of claim 1, wherein the horizontal axis is orthogonal to the first vertical axis and the second vertical axis.

13. An appliance defining a vertical direction, comprising:

a cabinet defining one or more chilled chambers;

an ice dispensing assembly, comprising:

a drive motor having an output shaft rotatable about a horizontal axis;

an ice bucket defining a cavity for stowing ice and defining an opening;

a dispenser crusher mechanism, comprising:

a housing defining a chamber, the chamber in communication with the opening of the ice bucket for receipt of ice;

a horizontal coupling assembly, comprising:

a coupling operatively coupled with the output shaft of the drive motor;

a horizontal shaft coupled with the coupling and rotatable about the horizontal axis;

a horizontal transmission gear mounted to or integrally formed with the horizontal shaft, the horizontal transmission gear rotatable with the horizontal shaft in unison;

a vertical drive assembly received within the chamber and defining a first vertical axis substantially orthogonal to the horizontal axis, the vertical drive assembly comprising:

a vertical shaft rotatable about the first vertical axis;

a vertical transmission gear mounted to or integrally formed with the vertical shaft and in mechanical engagement with the horizontal transmission gear of the horizontal coupling assembly;

a drive gear mounted to or integrally formed with the vertical shaft;

a drum assembly defining a second vertical axis, the drum assembly comprising:

a drum received within the chamber and rotatable about the second vertical axis, the drum in mechanical engagement with the drive gear;

an upper bridge carried by the drum and rotatable about the second vertical axis;

a lower bridge carried by the drum and rotatable about the second vertical axis;

a main shaft extending along the second vertical axis, the upper and lower bridges each coupled with the main shaft, the upper bridge coupled with the main shaft above where the lower bridge is coupled with the main shaft along the vertical direction;

at least one rotating blade coupled with the main shaft and with the upper and lower bridges, the upper and lower bridges configured to rotate the at least one rotating blade about the second vertical axis; and at least one non-rotating blade coupled with the main shaft.

14. The appliance of claim 13, further comprising:

a door rotatably mounted to the cabinet, and wherein the ice dispensing assembly is mounted on the door.

15. The appliance of claim 13, wherein the main shaft extends between a top end and a bottom end along the vertical direction, and wherein the upper bridge comprises an extension portion that extends above the top end of the main shaft along the vertical direction.

16. The appliance of claim 13, wherein the drive gear is a spur gear.

17. The appliance of claim 13, further comprising:

a top plate;

an upper bridge spacer disposed between and spacing the upper bridge from the lower bridge along the second vertical axis, the upper bridge spacer coupling the upper bridge with the main shaft and comprising a rounded portion that provides a bearing surface upon which the upper bridge is rotatable about the second vertical axis;

a lower bridge spacer disposed between and spacing the lower bridge from the top plate along the second vertical axis, the lower bridge spacer coupling the lower bridge with the main shaft and comprising a rounded portion that provides a bearing surface upon which the lower bridge is rotatable about the second vertical axis.

18. The appliance of claim 13, wherein the upper bridge and the lower bridge each comprise prongs defining a gap therebetween, and wherein the at least one rotating blade is received within the gap between the prongs of the upper and lower bridges to couple the upper and lower bridges with the at least one rotating blade.

* * * * *